United States Patent [19]

Bruderer et al.

[11] Patent Number: 4,655,118

[45] Date of Patent: Apr. 7, 1987

[54] ARRANGEMENT FOR LOCKING A BREECHBLOCK HEAD AT THE REAR END OF A WEAPON BARREL

[75] Inventors: Werner Bruderer; Erwin Bohler, both of Zürich, Switzerland

[73] Assignee: Werkzeugmaschinenfabrik Oerlikon-Bührle AG, Zürich, Switzerland

[21] Appl. No.: 801,625

[22] Filed: Nov. 25, 1985

[30] Foreign Application Priority Data

Dec. 20, 1984 [CH] Switzerland ..... 06064/84

[51] Int. Cl.[4] ..... F41D 3/06

[52] U.S. Cl. ..... 89/185

[58] Field of Search ..... 42/16; 89/166, 172, 89/185

[56] References Cited

U.S. PATENT DOCUMENTS

| | | | |
|---|---|---|---|
| 1,517,483 | 12/1924 | Young | 89/183 |
| 2,941,449 | 6/1960 | Reed | 89/185 |
| 3,429,223 | 2/1969 | Seccombe | 89/172 |

FOREIGN PATENT DOCUMENTS

| | | |
|---|---|---|
| 135870 | 2/1900 | Fed. Rep. of Germany . |
| 51131 | 3/1910 | Switzerland . |
| 89966 | 7/1921 | Switzerland . |
| 476964 | 8/1969 | Switzerland . |

*Primary Examiner*—Stephen C. Bentley

*Attorney, Agent, or Firm*—Werner W. Kleeman

[57] ABSTRACT

It has been shown that at high firing rates or cadences, especially in externally powered firing weapons like Gatling guns, the rebound of the breechblock head during its locking at the rear end of the weapon barrel can have damaging effects. At its rear end the weapon barrel possesses an internal circumferential groove following, in a forward direction of the weapon barrel, an annular flange provided with teeth forming an inner gear toothing. The breechblock head possesses teeth forming an outer gear toothing. In the locked position of the breechblock head the teeth of its outer gear toothing are located in the aforementioned internal circumferential groove and bear upon the teeth forming the inner gear toothing of the annular flange. The damaging effects due to the rebound of the breechblock head can be alleviated or completely avoided by widening the circumferential groove.

3 Claims, 5 Drawing Figures

FIG. 1
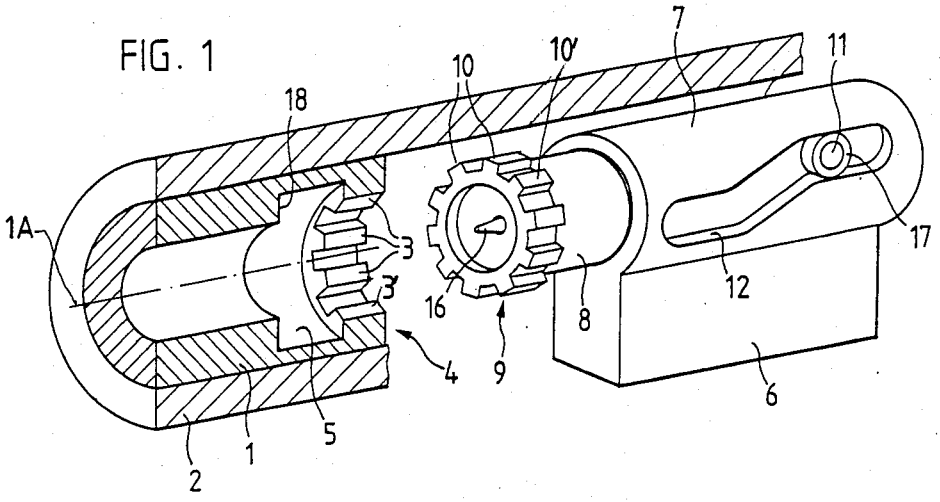
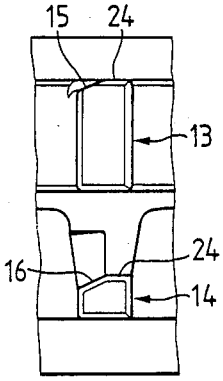
FIG. 3
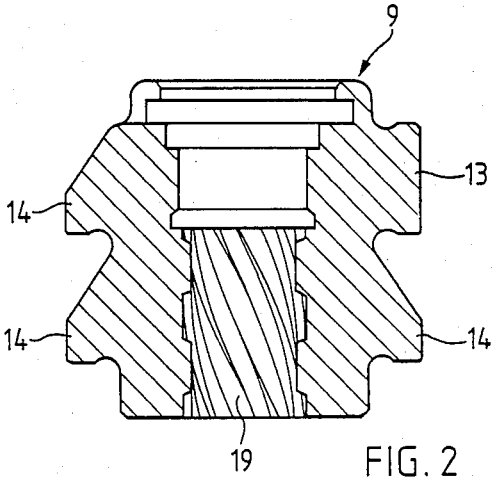
FIG. 2
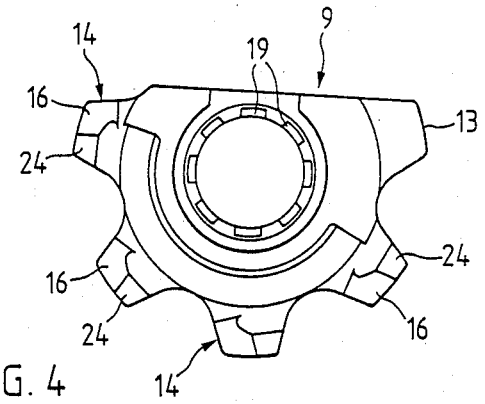
FIG. 4

ARRANGEMENT FOR LOCKING A BREECHBLOCK HEAD AT THE REAR END OF A WEAPON BARREL

CROSS-REFERENCE TO RELATED PATENT

This application is related to the commonly assigned U.S. Pat. No. 4,550,641, granted Nov. 5, 1985, and the disclosure of this patent is incorporated into the instant application by reference.

BACKGROUND OF THE INVENTION

The present invention broadly relates to a new and improved construction of an arrangement for locking a breechblock head in a predetermined position at the rear end of a weapon barrel.

In its more particular aspects, the present invention relates to a new and improved construction of an arrangement for locking a breechblock head in a predetermined position at the rear end of a weapon barrel of a firing weapon containing a reciprocatable breechblock head. This rear end of the weapon barrel possesses an internal circumferential groove which follows, in a forward direction of the weapon barrel, an inner annular flange with teeth forming an inner gear toothing. The breechblock head possesses teeth forming an outer gear toothing. In the predetermined locked position of the breechblock head, the teeth forming the outer gear toothing provided at the breechblock head are located in the internal circumferential groove or locking space and these teeth bear upon the teeth of the inner gear toothing provided at the inner annular flange of the weapon barrel.

A locking arrangement for linearly movable breechblocks in hand firearms as known, for example, from Swiss patent No. 51,131, granted Mar. 9, 1910, contains a breechblock member which is locked at a breechblock housing. During this operation, locking lugs which are provided at a rotatable cylinder of the breechblock are turned or rotated in recesses or locking recesses which are provided at the ends of guide grooves guiding the locking lugs.

Side walls of the locking recesses possess components which form a large angle of inclination with a longitudinal axis of the guide grooves. Further side wall components follow the aforementioned components and the guide grooves and form a smaller angle of inclination with the longitudinal axis of the guide grooves. Upon unlocking the breechblock head, empty cartridge cases are gradually loosened by means of the first mentioned side wall components and the breechblock member is pushed backwards by the further side wall components in order to effect a partial withdrawal of the fired cartridge shells from the weapon barrel.

It has been shown that the forward moving breechblock head rebounds at the weapon barrel and thus there exists the danger that the teeth forming the inner gear toothing of the weapon barrel as well as the teeth forming the outer gear toothing at the breechblock head will be damaged during the breechblock locking operation. The danger of such rebound is particularly pronounced in a Gatling gun in which the breechblock head respectively moves at the start and at the end of a continuous or series firing operation without a cartridge being inserted into the weapon barrel. The danger of the aforementioned rebound further exists in an externally powered weapon or gun containing a positively reciprocated breechblock which possesses a curve or cam follower roll which is guided by a control cam and by means of which the breechblock is reciprocated.

In order to avoid this rebound the breechblock should no longer possess any velocity when arriving at its foremost position, i.e. the control cam would have to possess zero slope exactly at this location. The impact energy could be reduced by changing the shape of the control cam.

SUMMARY OF THE INVENTION

Therefore, with the foregoing in mind, it is a primary object of the present invention to provide a new and improved arrangement for locking a breechblock head in a predetermined position at the rear end of a weapon barrel and which does not exhibit the aforementioned drawbacks and shortcomings of the prior art construction.

A further more specific object of the present invention aims at providing a new and improved construction of an arrangement for locking a breechblock head in a predetermined position at the rear end of a weapon barrel and in which there is prevented damage to the teeth forming the inner gear toothing at the weapon barrel and the teeth forming the outer gear toothing of the breechblock head and which damage results from the rebound of the breechblock head.

Now in order to implement these and still further objects of the invention, which will become more readily apparent as the description proceeds, the arrangement of the present development is manifested by the features that, the internal circumferential groove possesses chamfered portions at an annular front end face remote from the inner annular flange. Such chamfers or chamfered portions are inclined relative to an axis defined by the weapon barrel, such that, during locking the breechblock head in its predetermined position, the breechblock head is rearwardly displaced along the chamfers or chamfered portions and a backlash-free or play-free locking of the breechblock head is ensured.

Preferably, the internal circumferential groove possesses at its annular front end face a crown gear toothing formed by teeth and gaps therebetween. The teeth formed at the breechblock head enter the crown gear toothing during the forward movement of the breechblock head, so that an excess displacement or overstroke of the breechblock head is ensured during its forward movement.

The construction of the inventive arrangement for locking the breechblock head in a predetermined position at the rear end of a weapon barrel has the following advantages:

(a) A greater displacement, namely an excess displacement or overstroke of the breechblock head, is rendered possible because of the widening of the internal circumferential groove at predetermined locations. Thus, the breechblock head impacts the annular front end face bounding the internal circumferential groove at a smaller speed, i.e. at reduced energy, and consequently is also subject to a less pronounced rebound.

(b) Due to the widening of the internal circumferential groove at the predetermined locations a further rotation of the breechblock head is enabled before the teeth forming the outer gear toothing of the breechblock head impact at the teeth forming the inner gear toothing at the inner annular flange of the weapon barrel, which has the effect that the impact or contact area between the two gear toothings or teeth arrangements is increased. Preferably, the internal circumferential groove has a width such that there is ensured backlash-free or play-free locking of the breechblock head in the weapon barrel. In this case the space between the end faces of the inner gear toothing and the end faces of the crown gear toothing corresponds to the width of the outer gear toothing provided at the breechblock head.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 1 shows in a perspective view a longitudinal section through a breech mechanism of an automatic firearm or firing weapon and a breechblock in its unlocked position, and illustrates a first exemplary embodiment of the inventive arrangement;

FIG. 2 is a longitudal section through the breechblock body of a second exemplary embodiment of the inventive arrangement;

FIG. 3 is a side view of the breechblock body shown in FIG. 2;

FIG. 4 is a front view of the breechblock body shown in FIG. 2; and

DETAILED DESCRIPTION OF THE PREFERRED EMBODIMENTS

Figure 5:
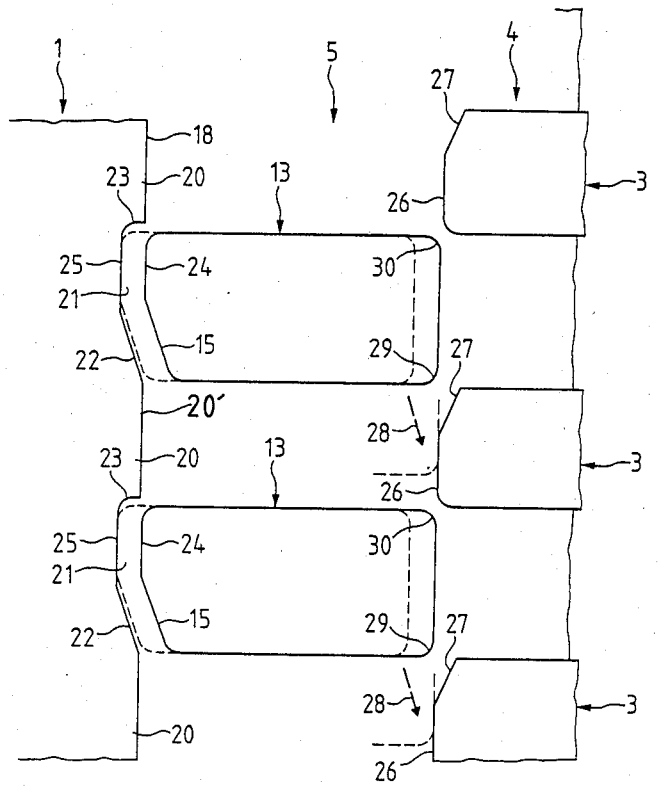
FIG. 5 is a schematic illustration in a development view and shows the engagement of the breechblock body and the breechblock housing in the inventive arrangement shown in FIGS. 1 and 2.

Describing now the drawings, it is to be understood that to simplify the showing thereof, only enough of the structure of the arrangement has been illustrated therein as is needed to enable one skilled in the art to readily understand the underlying principles and concepts of this invention. Turning now specifically to FIG. 1 of the drawings, a first exemplary embodiment of the inventive arrangement depicted by way of example and not limitation therein will be seen to comprise only a portion of the breechblock housing 2 of a firing weapon or firearm containing at least one weapon barrel 1 which defines a weapon barrel axis 1A. The rear end of the weapon barrel 1 is fixed to this breechblock housing 2 in a conventional, and therefore here not particularly shown manner. This rear end of the weapon barrel 1 possesses an inner annular flange 4 provided with teeth 3 which form an inner gear toothing or inner teeth arrangement 3'. An internal circumferential groove 5 is located in front of the inner annular flange 4 in a forward direction and on the inside of the weapon barrel 1.

Behind the weapon barrel 1, as seen in the forward direction of such weapon barrel 1, there is arranged on the inside of the breechblock housing 2, a breechblock carrier 6 to which is fixed a breechblock carrier sleeve 7. A cylindrical breechblock body 8 is rotatably mounted inside this breechblock carrier sleeve 7. At its forward end as seen in the forward direction of the weapon barrel 1 this breechblock body 8 possesses a breechblock head 9 which is provided with teeth 10 forming an outer gear toothing 10' or outer teeth arrangement. The spacings or gaps between the teeth 3 forming the inner gear toothing 3' of the inner annular flange 4 are dimensioned such that the teeth 10 of the outer gear toothing 10' of the breechblock head 9 can be displaced through these tooth spacings or gaps.

As soon as the breechblock head 9 with its outer gear toothing 10' is located in the internal circumferential groove 5 of the weapon barrel 1, then, the breechblock body 8 with the breechblock head 9 can be rotated through one tooth pitch. The teeth 10 forming the outer gear toothing 10' at the breechblock head 9 are then positioned exactly in front of the teeth 3 forming the inner gear toothing 3' at the inner annular flange 4 of the weapon barrel 1, whereby the breechblock body 8 conjointly with its breechblock head 9 is locked in its predetermined position in the weapon barrel 1.

A cam bolt or pin 11 is fastened to the breechblock body 8 for rotating the breechblock body 8 in the breechblock carrier sleeve 7. Both ends of this cam bolt or pin 11 project into a helically-shaped control groove or slot 12 of the breechblock carrier sleeve 7. Only one of these two control grooves or slots 12 is visible in FIG. 1. A sleeve 17 is rotatably mounted at both ends of the cam bolt or pin 11 and such sleeves 17 project into related helically-shaped control grooves or slots 12 of the breechblock carrier sleeve 7.

The mode of operation of the arrangement described hereinbefore, constitutes state of the art and therefore is understood to be known, see, for example, U.S. Pat. No. 3,969,983 and Swiss patent No. 570,599. This mode of operation is as follows:

At the moment of firing a here not particularly shown cartridge located in the weapon barrel 1, the breechblock carrier 6 conjointly with the breechblock carrier sleeve 7 is located in its foremost position in which the breechblock body 8 conjointly with the breechblock head 9 is locked in the weapon barrel 1. Consequently, the cam bolt or pin 11 is situated at the rear end of the helically-shaped control groove or slot 12. The breechblock carrier 6 conjointly with the breechblock carrier sleeve 7 is rearwardly displaced under the action of the gas pressure of the fired cartridge, specifically at first due to the backward or recoil movement of the weapon barrel 1 and subsequently through a here not particularly shown plunger. During these movements the breechblock carrier 6 is displaced relative to the breechblock body 8 and the breechblock head 9. The cam bolt or pin 11 is displaced in the helically-shaped control groove or slot 12. During this movement the breechblock body 8 is rotated in the breechblock carrier sleeve 7 and the locking action between the breechblock head 9 and the weapon barrel 1 is released. As a result, the breechblock head 9 with its teeth 10 can slide through between the teeth 3 at the inner annular flange 4, and the breechblock body 8 conjointly with the breechblock head 9 is rearwardly displaced relative to the weapon barrel 1.

The locking action is achieved in reverse manner. The relative movement between the breechblock body 8 and the breechblock carrier 6 only takes place when the breechblock body 8 has reached its foremost position and the teeth 10 of the breechblock body 8 are positioned in the internal circumferential groove 5 of the weapon barrel 1.

In accordance with the second exemplary embodiment of the inventive arrangement shown in FIGS. 2 to 4, two rows of teeth 13 and 14 are provided at the breechblock head 9 and engage a corresponding inside or internal toothing formed in the weapon barrel 1 also by two rows of teeth. As can be clearly seen especially in FIGS. 3 and 5, the teeth 13 and 14 of the breechblock head 9 possess at their front ends as seen in the forward direction of the weapon barrel 1, related chamfers or chamfered portions 15 and 16.

In accordance with FIG. 2 the breechblock head 9 possesses a steep pitch inner thread 19 into which engages a here not particularly shown bolt with a corresponding steep pitch outer thread. This bolt is fixed at the breechblock body 8 and causes the breechblock head 9 to rotate. Therefore, the control groove or slot 12 described with reference to the first exemplary embodiment, is no longer necessary in the presently described second exemplary embodiment of the inventive arrangement.

A development view of the teeth 13 at the breechblock head 9 shown in FIG. 2 and the teeth 3 of the inner gear toothing 3' of the inner annular flange 4 at the weapon barrel 1 shown in FIG. 1 is schematically illustrated in FIG. 5. The internal circumferential groove 5 in front of the inner annular flange 4 is bounded at the front as seen in the forward direction of the weapon barrel 1 by means of an annular front end face or surface 18 which is remote from the inner annular flange 4. This annular front end face or surface 18, in accordance with FIG. 5, also possesses teeth 20 and tooth spacings or gaps 21 which conjointly form a crown gear toothing 20'. The transition from a tooth spacing or gap 21 to a tooth 20 is provided on one side by means of a bevelling or bevelled portion 22 and on the other side through a steep-gradient flank 23. The bevellings or bevelled portions 22 in the annular front end faces or surfaces 18 correspond to the chamfers or chamfered portions 15 of the teeth 13 at the breechblock head 9. Each chamfer or chamfered portion 15 merges with a front surface 24 of the related tooth 13 as seen in the forward direction of the weapon barrel 1. The teeth 3 of the inner gear toothing 3' at the inner annular flange 4 also possess at their front ends as seen in the forward direction of the weapon barrel 1, related bevellings or bevelled portions 27 next to an end face or surface 26. At their rear ends, the teeth 13 possess related rear edges 29 and related rear end faces or surfaces 30.

The construction of the annular front end face or surface 18 in the manner of a crown gear toothing 20' with teeth 20 and tooth spacings or gaps 21, which are provided with related bevellings or bevelled portions 22 and flanks 23, and the construction of the teeth 3 of the inner gear toothing 3' at the inner annular flange 4 with related bevellings or bevelled portions 27 at their front faces or surfaces 26 constitute subject matter of the present invention and their purpose and mode of operation are therefore described in detail in the following:

It cannot be avoided, not even by means of a controlled reciprocating movement of the breechblock head 9, that during the forward advance or displacement of the breechblock head 9, i.e. during the entry of the breechblock head 9 into the rear end of the weapon barrel 1, the teeth 13 impact with their front end face or surface 24 against the base or bottom 25 of the related tooth spacings or gaps 21. As the breechblock head 9 rotates in the manner described hereinbefore for the locking action in the weapon barrel 1, the rebound of the breechblock head 9 takes place in the direction of the arrow 28. Consequently, and in the case of a pronounced rebound, it cannot be prevented that the teeth 13 of the breechblock head 9 impact with their rear end faces or surfaces 30 against the related teeth 3 of the gear toothing 3' at the inner annular flange 4. The position of the teeth 13 of the breechblock head 9 after the first impact against the related base or bottom 25 of the related tooth spacings or gaps 21 and during the second impact against the bevellings or bevelled portions 27 is indicated by dashed lines in FIG. 5. With increasing width of the internal circumferential groove 5 in the weapon barrel 1 the breechblock head 9 conjointly with the teeth 13 can rotate through an increased angle of rotation before the rear end faces or surfaces 30 of the teeth 13 at the breechblock head 9 impact at the related front end faces or surfaces 26 of the teeth 3 of the gear toothing 3' at the inner annular flange 4 in the weapon barrel 1. Although the impact or contact surfaces are somewhat reduced by the bevellings or bevelled portions 27 at the front end faces or surfaces 26 of the teeth 3 which form the inner gear toothing 3' at the inner annular flange 4 of the weapon barrel 1, it is nevertheless prevented that the rear edges 29 of the teeth 13 which form the outer or external toothing 10' at the breechblock head 9, impact against the corresponding edges at the teeth 3 of the inner or internal gear toothing 3' at the inner annular flange 4.

The crown gear teeth 20 formed at the annular front end face or surface 18 which bounds the internal circumferential groove 5 in the weapon barrel 1, assure a backlash-free or play-free locking action of the breechblock head 9 in the weapon barrel 1. Preferably, the internal circumferential groove 5 has a width such that the backlash-free or play-free locking of the breechblock head 9 in the weapon barrel 1 is ensured, i.e. the distance or space between the front end faces or surfaces 26 of the teeth 3, which form the inner gear toothing 3' at the internal annular flange 4 in the weapon barrel 1, and the crown gear teeth 20 formed at the annular front end face or surface 18 which bounds the internal circumferential groove 5 in the weapon barrel 1, correspond to the width of the teeth 13 which form the outer gear toothing 10' at the breechblock head 9.

While there are shown and described present preferred embodiments of the invention, it is to be distinctly understood that the invention is not limited thereto, but may be otherwise variously embodied and practiced within the scope of the following claims.

Accordingly, what we claim is:

1. An arrangement for locking a reciprocatable breechblock head at a predetermined position in a rear end of a weapon barrel defining a weapon barrel axis, said arrangement comprising:

an inner annular flange provided at said rear end of said weapon barrel and possessing teeth forming an inner gear toothing;

an outer gear toothing formed by teeth provided at said breechblock head;

said rear end of said weapon barrel containing an internal circumferential groove arranged to follow said inner annular flange in a forward direction of said weapon barrel;

said teeth of said outer gear toothing provided at said breechblock head being located in said internal circumferential groove and bearing upon said teeth of said inner gear toothing of said inner annular flange when said breechblock head is locked at said predetermined position in said rear end of said weapon barrel;

said internal circumferential groove being bounded by an annular front end face located remote from said inner annular flange;

said annular front end face which bounds said internal circumferential groove, being provided with chamfered portions; and said chamfered portions provided at said annular front end face bounding said internal circumferential groove, being inclined relative to said weapon barrel axis such that said breechblock head, during the process of being locked at said predetermined position in said rear end of said weapon barrel, is rearwardly displaced along said chamfered portions in order to thereby insure essentially backlash-free locking of said breechblock head at said predetermined position in said rear end of said weapon barrel.

2. The arrangement as defined in claim 1, wherein:

said internal circumferential groove is provided at said annular front end face remote from said inner annular flange, with a crown gear toothing formed by crown gear teeth and tooth spacings therebetween; and said teeth forming said outer gear toothing provided at said breechblock head, entering said tooth spacings between said crown gear teeth at said annular front end face bounding said internal circumferential groove, during a forwardly directed displacement of said reciprocatable breechblock head, in order to thereby ensure an excess displacement during said forwardly directed displacement of said reciprocatable breechblock head.

3. The arrangement as defined in claim 2, wherein:

each one of said teeth forming said inner gear toothing at said inner annular flange provided at said rear end of said weapon barrel, defines a front end face facing said annular front end face bounding said internal circumferential groove; and said front end face of each one of said teeth forming said inner gear toothing of said inner annular flange being provided with bevelled portions.

* * * * *